US006610946B2

(12) United States Patent
Covell et al.

(10) Patent No.: US 6,610,946 B2
(45) Date of Patent: Aug. 26, 2003

(54) ACTUATION MECHANISM FOR A POWER TOOL

(75) Inventors: Kevin W. Covell, Freeland, MD (US); John Vantran, Parkton, MD (US); Robert P. Wagster, Baltimore, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 09/976,486

(22) Filed: Oct. 12, 2001

(65) Prior Publication Data

US 2002/0153237 A1 Oct. 24, 2002

Related U.S. Application Data

(60) Provisional application No. 60/285,136, filed on Apr. 20, 2001.

(51) Int. Cl.[7] ..... H01H 1/52; H01H 3/20; H01H 9/00

(52) U.S. Cl. ..... 200/321; 200/17 R; 200/61.85; 200/522; 200/332.2

(58) Field of Search ..... 200/1 V, 17 R, 200/18, 61.85, 318, 318.1, 321, 322, 322.2, 327, 329, 332, 332.2, 334, 520, 522

(56) References Cited

U.S. PATENT DOCUMENTS

| | | | | |
|---|---|---|---|---|
| 1,361,431 A | | 12/1920 | Wilson | |
| 1,929,662 A | | 10/1933 | Wappat | 200/157 |
| 2,346,778 A | | 4/1944 | Mitchell | 172/36 |
| 2,420,585 A | | 5/1947 | Crimmins | 200/60 |
| 3,249,725 A | | 5/1966 | Hutt | 200/153 |
| 3,378,662 A | | 4/1968 | Sorenson | 200/157 |
| 3,383,943 A | | 5/1968 | Piber | 74/529 |
| 3,510,099 A | | 5/1970 | Crump | 251/116 |
| 3,564,186 A | | 2/1971 | Mittelstadt | 200/172 |
| 3,780,246 A | * | 12/1973 | Beckering et al. | 200/157 |
| 3,847,233 A | | 11/1974 | Glover et al. | 173/170 |
| 4,095,071 A | | 6/1978 | Chamberlain | 200/157 |
| 4,122,320 A | * | 10/1978 | Edgell et al. | 200/157 |
| 4,454,785 A | | 6/1984 | Purrer | 74/523 |
| 4,847,451 A | * | 7/1989 | Nagata | 200/1 V |
| 5,120,922 A | | 6/1992 | Brouillette | 200/519 |
| 5,401,928 A | * | 3/1995 | Kelley | 200/510 |
| 5,813,522 A | | 9/1998 | Lin | 200/550 |
| 6,274,828 B1 | * | 8/2001 | Chu | 200/43.17 |
| 6,469,269 B1 | * | 10/2002 | Jong | 200/522 |

OTHER PUBLICATIONS

Locking mechanism described in the subject application in connection with Fig. 10, No date.

* cited by examiner

*Primary Examiner*—Karl D. Easthom
*Assistant Examiner*—Kyung Lee
(74) *Attorney, Agent, or Firm*—Harness, Dickey & Pierce, P.L.C.

(57) ABSTRACT

The power tool includes a body, a trigger mechanism and a manually operated locking member. The trigger mechanism is mounted to the body for rotation about an axis between an actuated position and a non-actuated position. The manually operable locking member is translationally mounted to the body for movement between a first position and a second position. The locking member cooperates with the trigger mechanism to provide first, second and third modes of operation. In the first mode, the locking member is in the first position and articulation of the trigger mechanism from the non-actuated position to the actuated position is precluded. In the second mode, the locking member is in an intermediate position between the first and second positions and the trigger mechanism is freely allowed to articulate between the actuated and non-actuated positions. In the third mode, the locking member is in the second position and the trigger mechanism is prevented from articulating from the non-actuated position to the actuated position.

20 Claims, 7 Drawing Sheets

ACTUATION MECHANISM FOR A POWER TOOL

CROSS REFERENCE TO RELATED APPLICATION

This invention relates to U.S. Provisional Application No. 60/285,136, filed Apr. 20, 2001.

FIELD OF THE INVENTION

The present invention is generally directed to power tools. In particular, the present invention is directed to a power tool having an actuation mechanism including an arrangement for preventing operation of the tool and also maintaining the tool in a continuous operating mode.

BACKGROUND OF THE INVENTION

Conventional electrical devices frequently include an electrical switch for controlling the operation of the device. Examples of such electrical devices are disclosed in U.S. Pat. Nos. 2,420,585 to Crimmins, U.S. Pat. No. 3,378,662 to Sorenson, U.S. Pat. No. 4,095,071 to Chamberlain, and U.S. Pat. No. 4,454,785 to Pürrer. Examples of electrical switches having a controlled movement include U.S. Pat. Nos. 3,249,725 to Hurt et al., U.S. Pat. No. 5,120,922 to Brouillette, and U.S. Pat. No. 5,813,522 to Lin.

Sorenson shows a typical power tool having an ON/OFF switch. This switch is controlled by a linkage including a trigger element, that is retracted into a body of the power tool against the action of a spring. The linkage further includes a plate having a row of serrations and a lock button. This lock button is biased by a spring out of engagement with the serrations. When the power tool is to be operated at a constant speed for extended periods of time, the trigger is retracted a desired distance and the lock button is depressed. This action causes the flange on the lock button to interengage one of the serrations, thus maintaining the trigger in the retracted position. Further retracting the trigger releases this interengagement and the lock button is moved out of engagement by the spring. Thus, the Sorenson linkage provides a consumer convenience feature for avoiding hand fatigue and for providing a mechanism that ensures the power tool can be continuously operated at a constant, predetermined speed for an extended period of time.

Another known arrangement providing the customer convenience feature of Sorenson is shown in FIG. 10. A power tool is shown to include an actuation mechanism including a trigger and a lock mechanism. In the illustrated position, lock out, the trigger is not able to be actuated. To actuate the trigger, the lock mechanism must be pushed to an intermediate position. Once, the trigger has been fully actuated, the lock mechanism may be pushed to a locking position, continuously engaging the trigger mechanism.

SUMMARY OF THE INVENTION

It is an object of the present invention is to provide a trigger mechanism including a locking device for blocking the movement of the trigger, thus preventing inadvertent operation of a power tool.

It is another object of the present invention to provide a trigger mechanism that is selectively positionable between a first mode blocking the movement of the trigger, a second mode allowing free manual movement of the trigger, and a third mode retaining the trigger in a position for continuous operation.

In one form, the present invention provides a power tool, a body, a trigger mechanism and a manually operated locking member. The trigger mechanism is mounted to the body for rotation about an axis between an actuated position and a non-actuated position. The manually operable locking member is translationally mounted to the body for movement between a first position and a second position. The locking member cooperates with the trigger mechanism to provide first, second and third modes of operation. In the first mode, the locking member is in the first position and articulation of the trigger mechanism from the non-actuated position to the actuated position is precluded. In the second mode, the locking member is in an intermediate position between the first and second positions and the trigger mechanism is freely allowed to articulate between the actuated and non-actuated positions. In the third mode, the locking member is in the second position and the trigger mechanism is prevented from articulating from the non-actuated position to the actuated position.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment is merely exemplary in nature and is in no way intended to limit the invention, its application, or uses.

Referring generally to FIGS. 2–9 wherein like numbers refer to like features, a portion of a power tool is generally indicated with the reference number 10. Examples of power tools of the type to which the present invention pertains include outdoor power equipment such as hedge trimmers, chain saws, edgers, grass shears, lawn mowers, lawn vacuums, leaf blowers, sprayers, and string trimmers. Additional examples of such power tools include circular saws, drills, grinders, heat guns, inflators, jig saws, planers, rotary tools, routers, sanders, screwdrivers, and vacuums. The power tool 10 may be powered by electricity (direct or alternating current) or by internal engine. Of course, the teachings of the present invention are also applicable to other types of equipment and tools, and may be used with alternate types of power sources.

Figure 2:
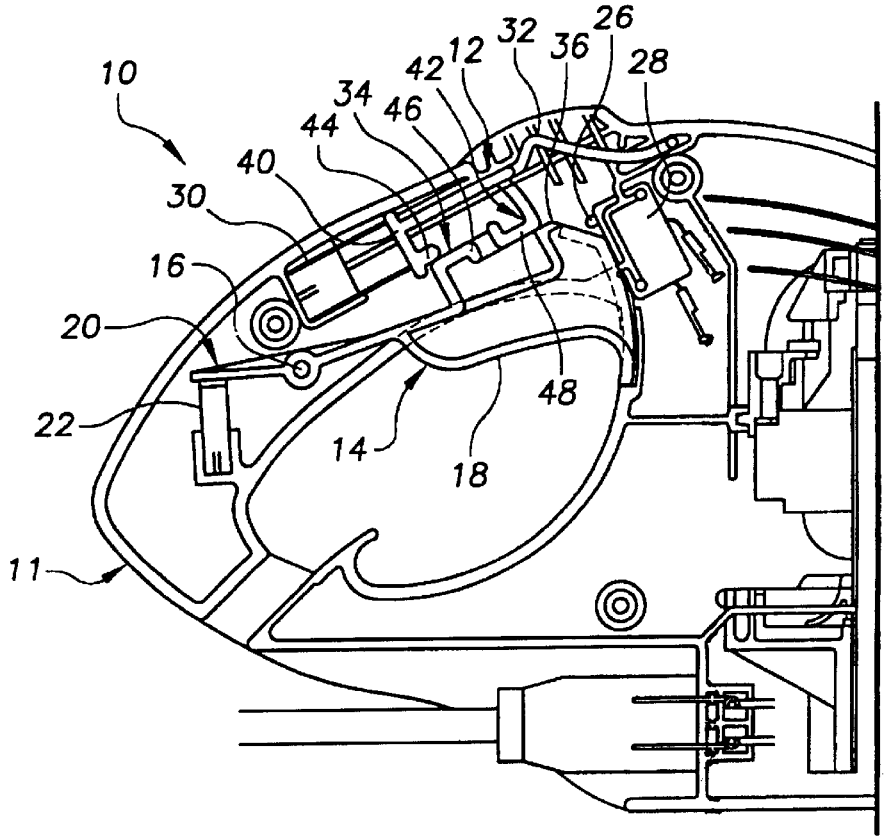
FIG. 2 is a partial and simplified side view of a power tool showing an actuation mechanism constructed in accordance with the present invention, a trigger of the tool shown in an at rest condition and the locking member shown in a forward position to block actuation of the trigger.
Figure 3:
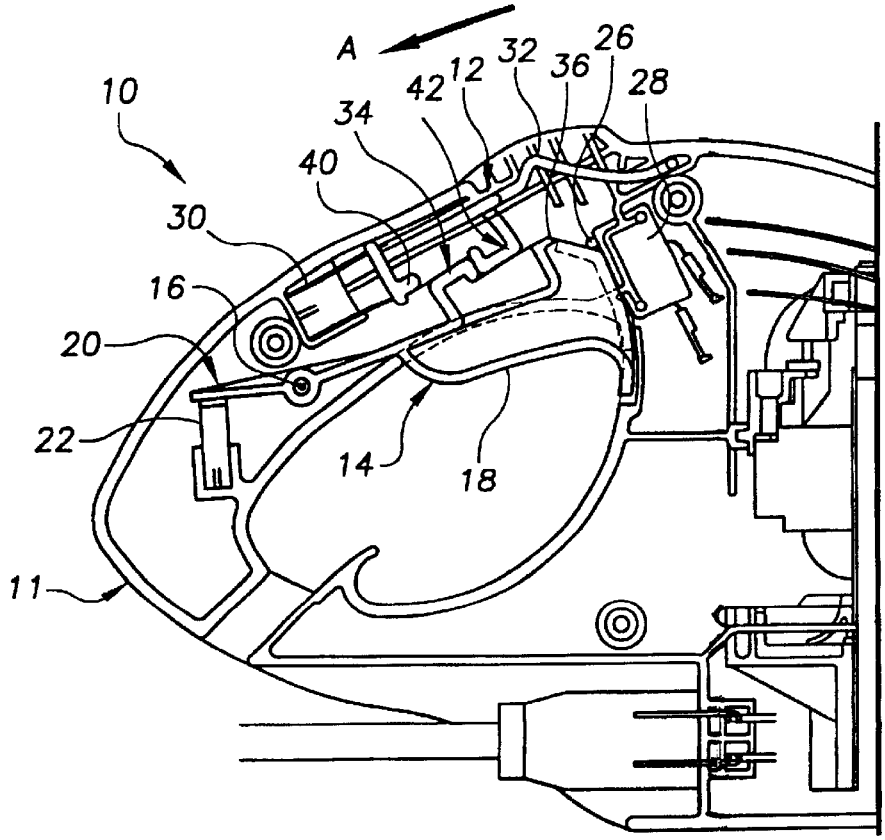
FIG. 3 is a partial and simplified side view similar to FIG. 2, illustrating the trigger in the at rest position and the locking member moved to an intermediate position permitting actuation of the trigger.
Figure 4:
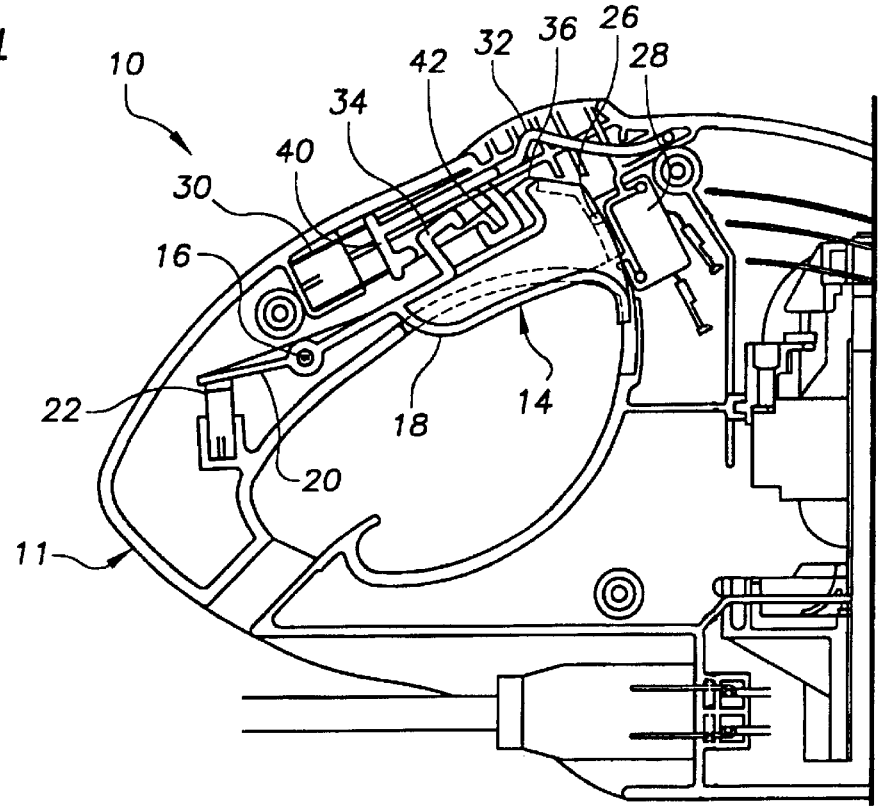
FIG. 4 is a partial and simplified side view similar to FIG. 3, illustrating the trigger in a fully actuated position.
Figure 5:
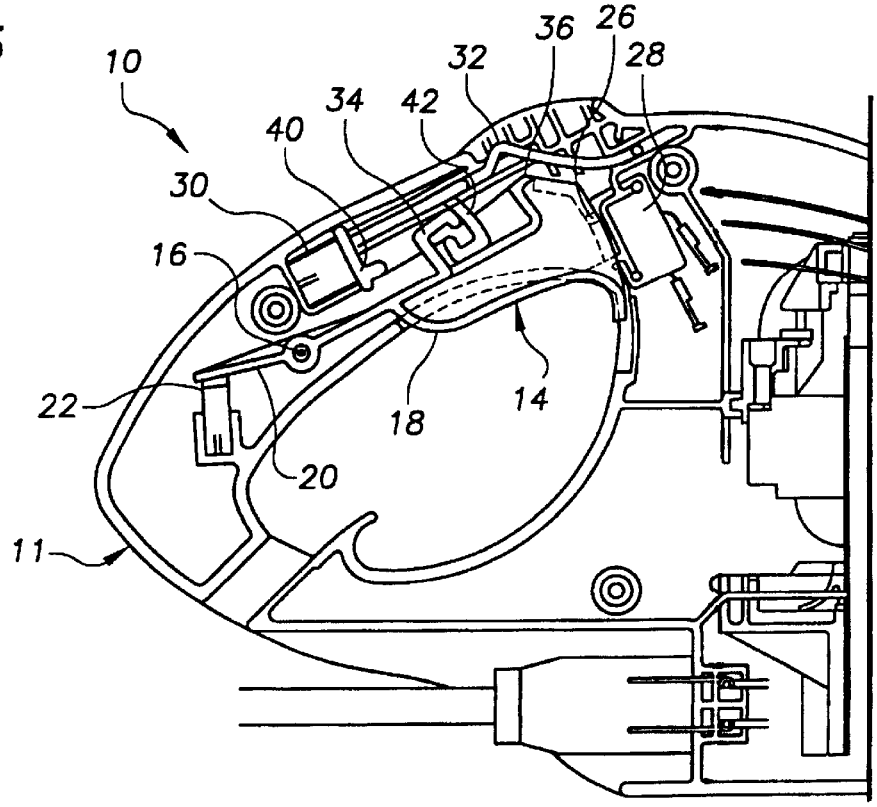
FIG. 5 is a partial and simplified side view similar to FIG. 2, illustrating the trigger in a fully actuated position and the locking member in its rearward position in which the trigger is prevented from freely returning to the at rest position.

In the exemplary embodiment illustrated, the power tool 10 is a hedge trimmer including a body 11 supporting the components of the hedge trimmer. The power tool 10 generally includes a locking member 12 and a trigger mechanism 14. The trigger mechanism 14 is pivotally supported on the body 11 for pivotal movement about a transversely extending pivot axis 16 such that the trigger mechanism 14 is divided into two parts, a trigger or actuation portion 18 forward of the pivot axis 16 and a biasing portion 20 rearward of the pivot axis 16. The trigger mechanism 14 is pivotable between an at rest position in which a motor of the tool 10 is not actuated and a fully actuated position. The at rest position is shown in FIGS. 2 and 3, for example. The fully actuated position is shown in FIGS. 4 and 5, for example.

Figure 1:
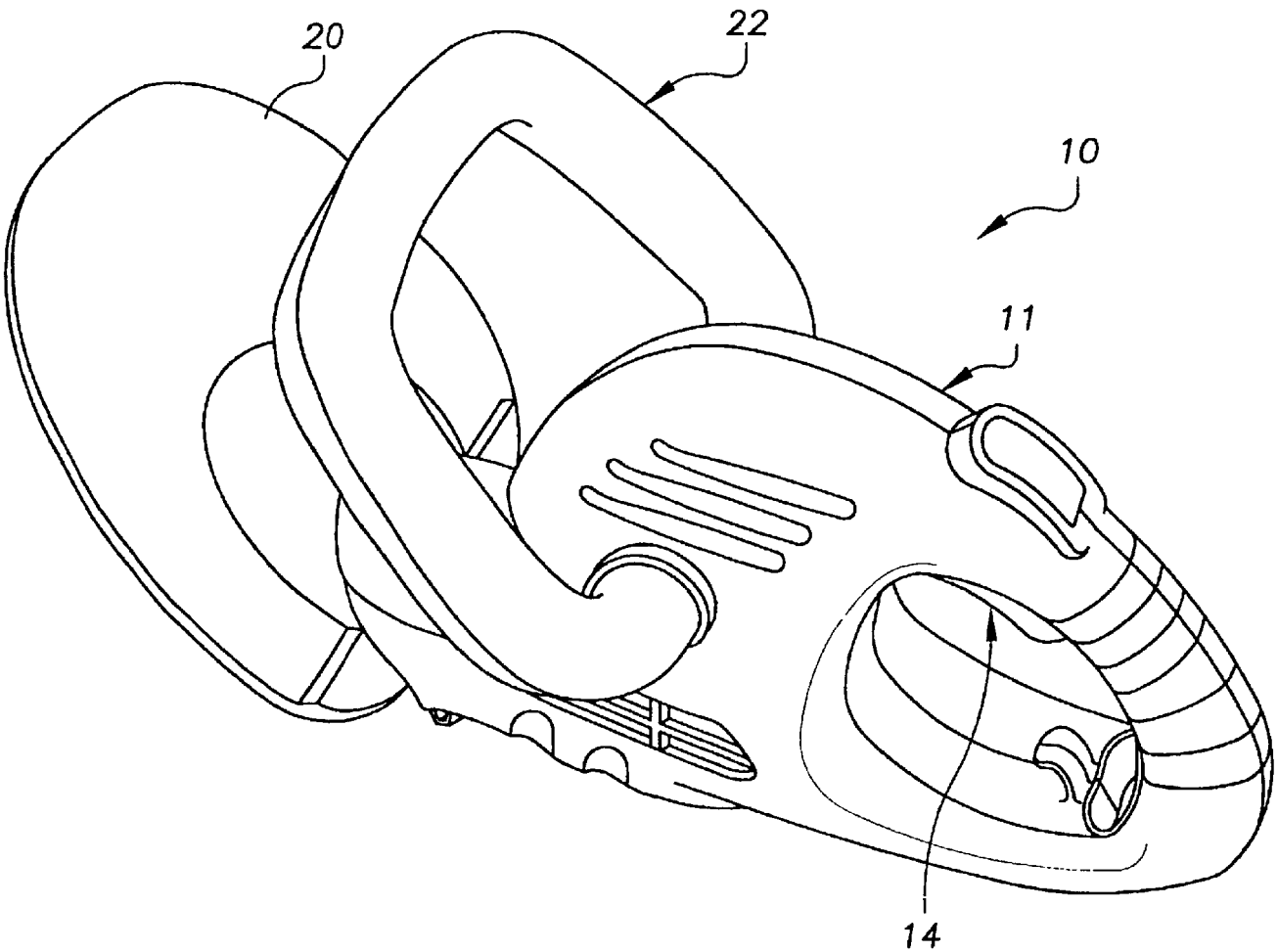
FIG. 1 is a partial and simplified side view of a prior art actuation mechanism of a power tool known in the art.

The range of movement of the actuation portion 18 is constrained by the locking member 12. A biasing element 22 normally urges the actuation portion 18 clockwise (as shown in the drawings) when there are no external forces with respect to the power tool 10 that act on the trigger mechanism 14. According to the preferred embodiment shown in FIG. 1, the biasing element 22 comprises a coil spring. However, it will be understood that alternate biasing members may be used to accomplish to the same function.

Figure 8:
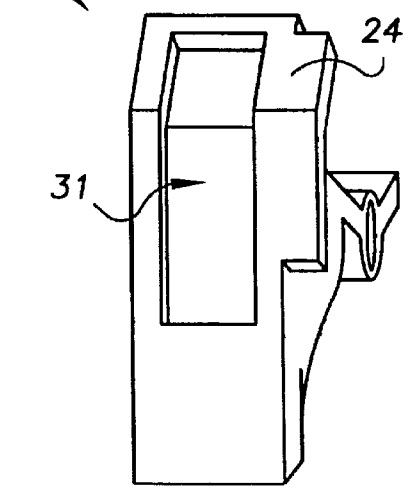
FIG. 8 is another second perspective view of the trigger according to the present embodiment.
Figure 9:
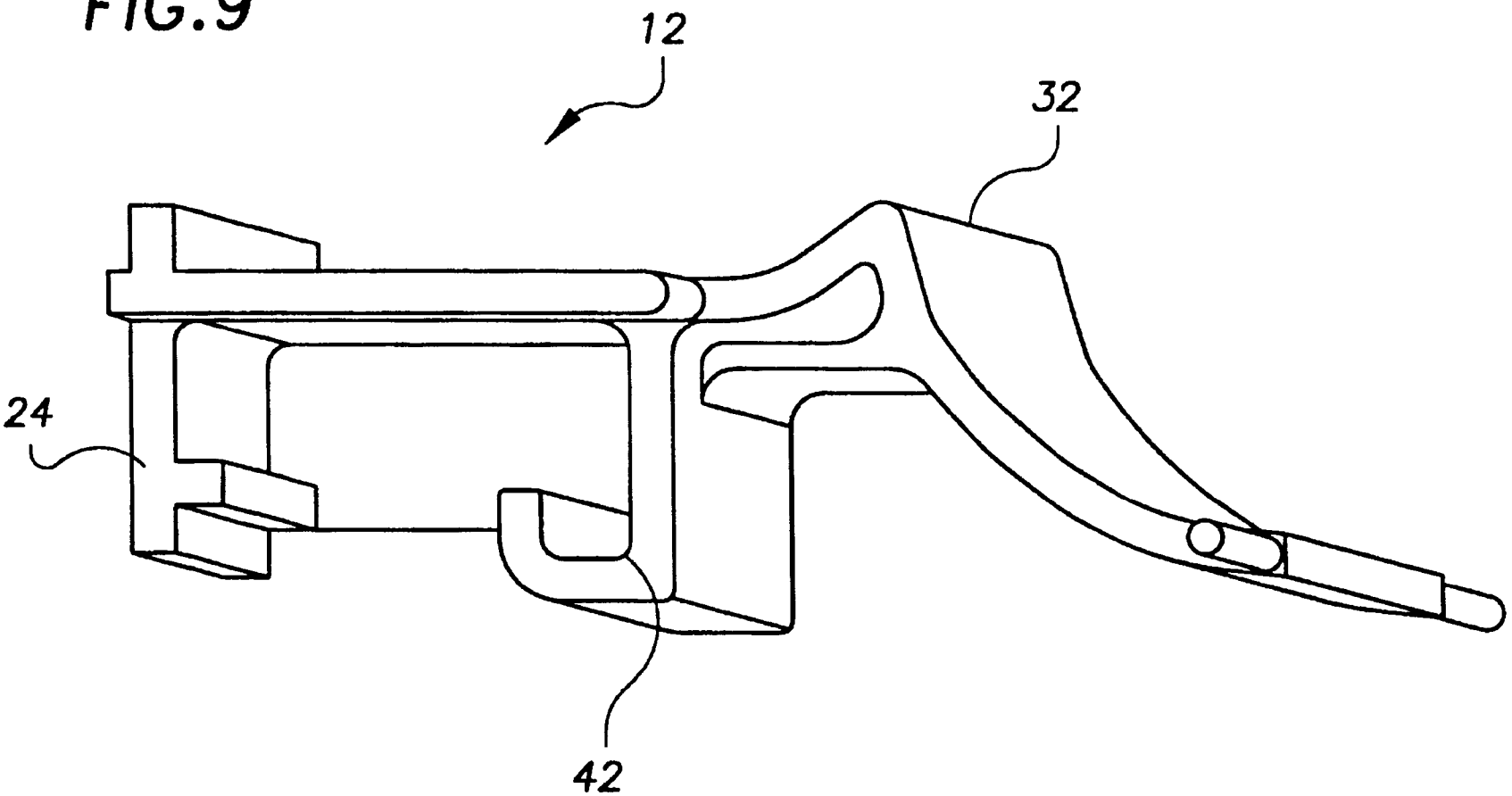
FIG. 9 is a perspective view of the locking member according to the present invention.
Figure 10:
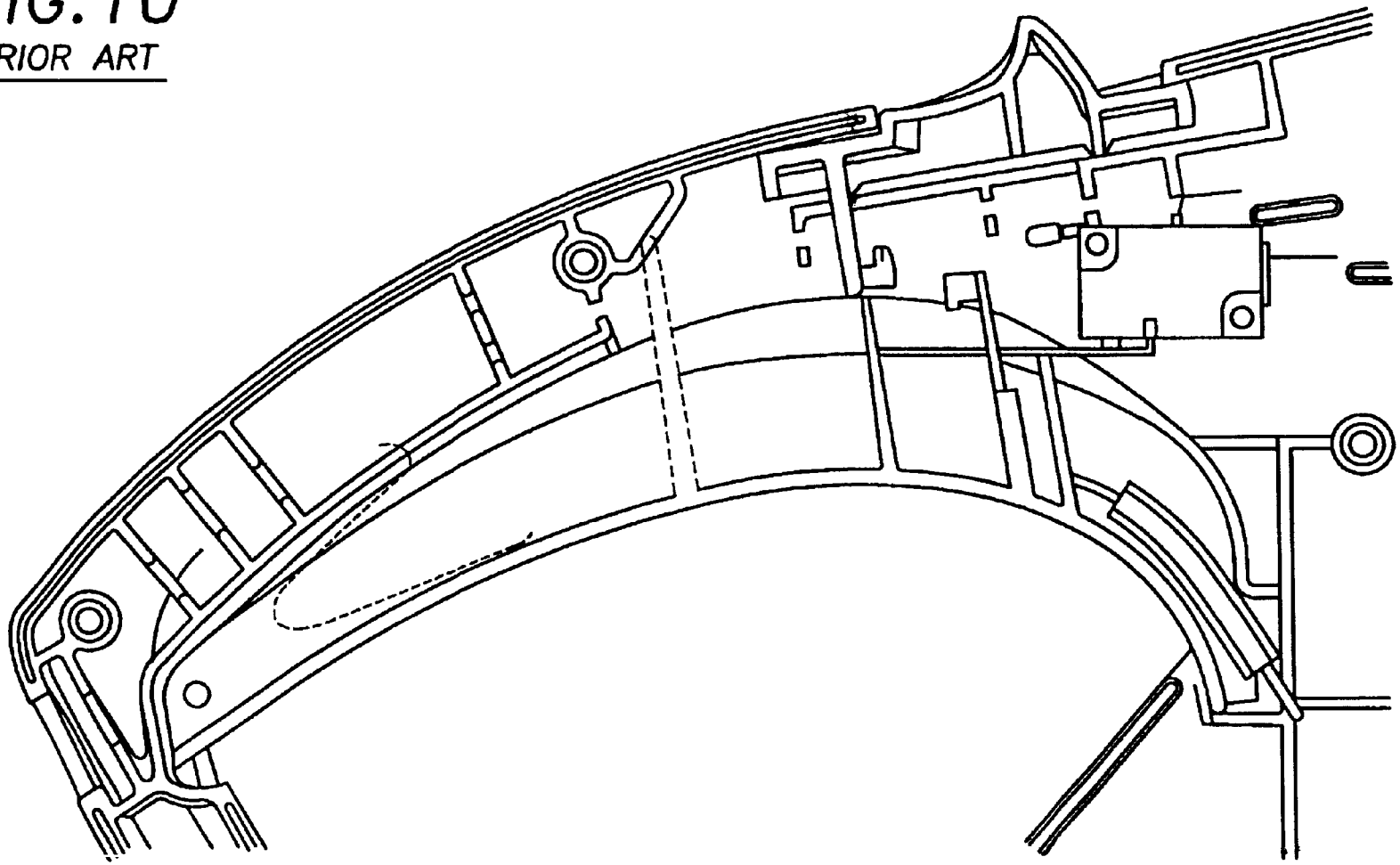
FIG. 10 PRIOR ART
FIG. 10 is a simplified side view of a power tool in accordance with the prior art.

During operation, the power tool's operator manually engages actuation portion 18 of the trigger mechanism 14 to rotate the trigger mechanism 14 about the pivot axis 16. The trigger mechanism 14 includes an actuator portion 24 which engages a throw switch 26 of regulator 28. According to a preferred embodiment of the present invention, a slot 31 (shown in FIG. 8) located in the distal end of actuator portion 24 receives and displaces throw switch 26. Of course, the trigger mechanism 14 may be configured and located with respect to the body 11 so that actuation portion 18 is engageable by a particular portion of the operator's body, e.g., one or more fingers. Additionally, trigger mechanism 14 as shown in FIG. 8 includes a guide protruding from the right side of actuator portion 24. The inclusion of this guide is optional.

The regulator 28 controlled by the throw switch 26 electrically connects a power source, e.g., a battery (not shown), to an actuator, e.g., a motor (not shown), of the power tool 10. According to the preferred embodiment shown in FIGS. 2–9, the regulator comprises an electric switch of the single-pole, single-throw type. Thus, the single throw switch 26 is moveable between an OFF position in which the motor is electrically disconnected from the power source, and an ON position in which the motor is electrically connected to the power source.

It is also envisioned that a variable resistance or other type of infinitely variable switch could be used to gradually vary the connection between the power source and the actuator. Such an infinitely variable switch would be able to adjustably control the speed or some other characteristic of the actuator. In the case of an internal combustion engine actuator, the regulator may comprise a carburetor controllingly connecting a power source, e.g., fuel supply, to the internal combustion engine. Of course, the carburetor could either provide discrete levels of internal combustion engine operation, or provide a gradually varying connection between the fuel supply and the internal combustion engine.

Figure 6:
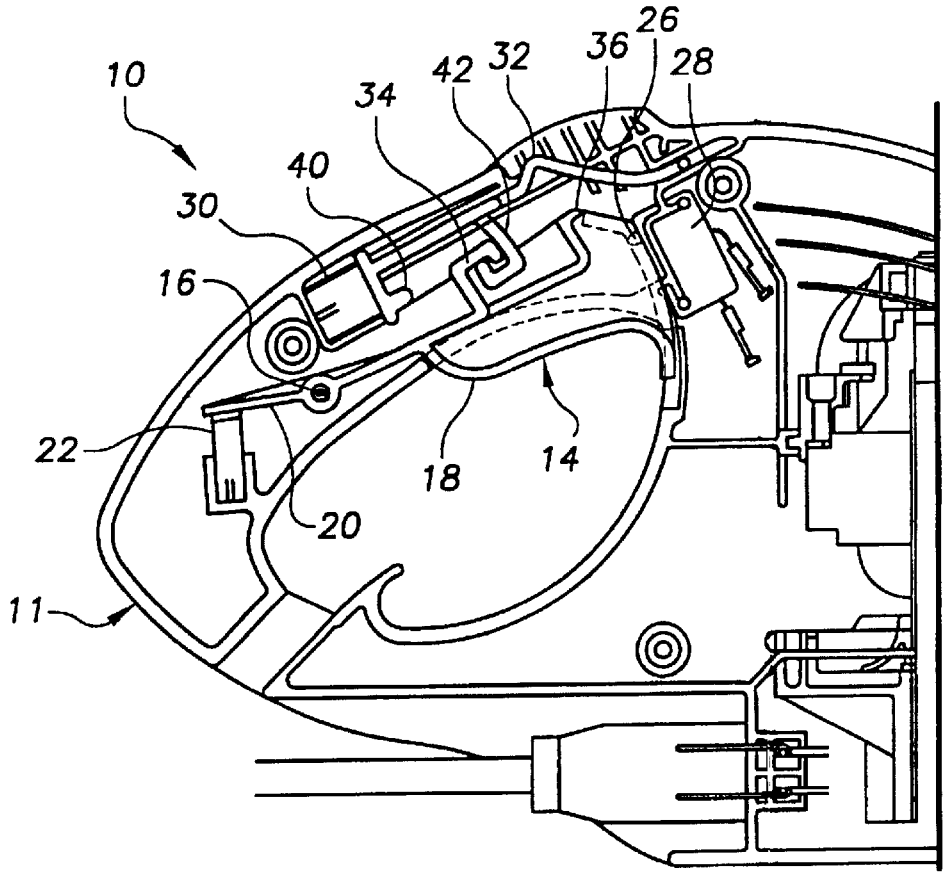
FIG. 6 is a partial and simplified side view similar to FIG. 5, illustrating the trigger after it has been released by the operator and the trigger engages the locking mechanism to prevent return to the at rest position.
Figure 7:
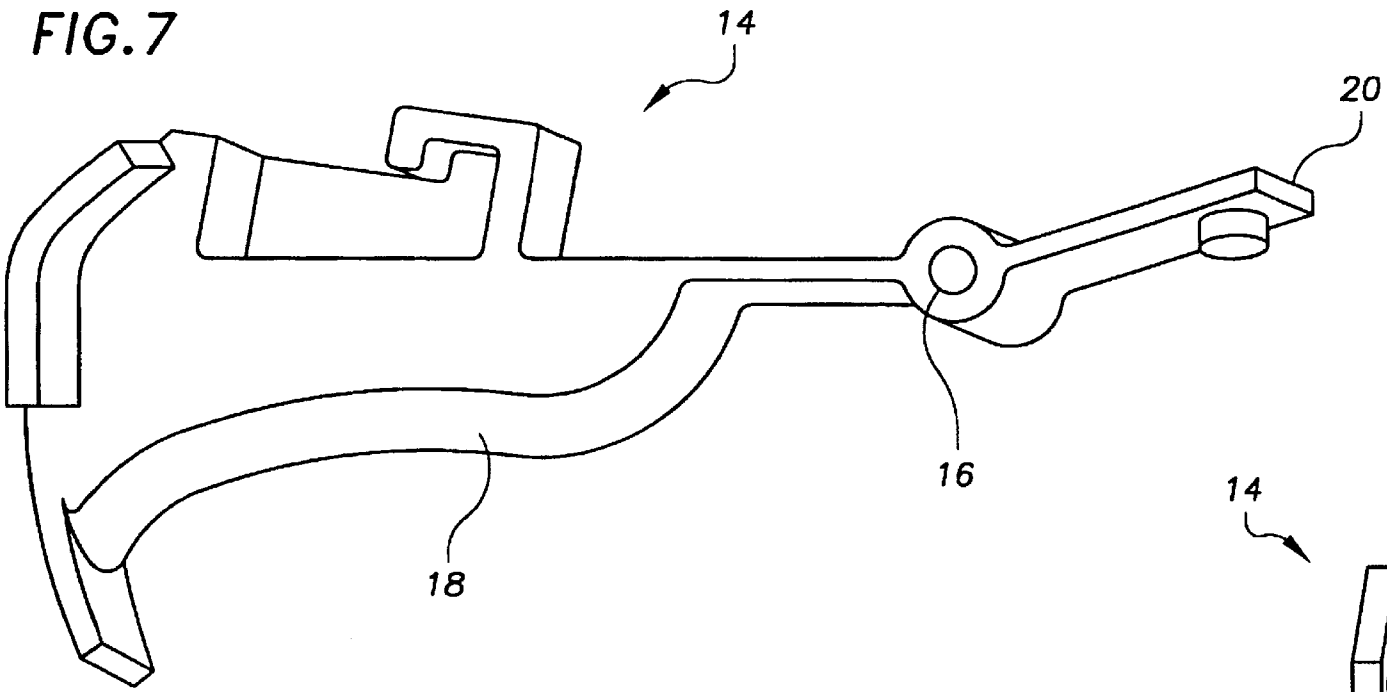
FIG. 7 is a perspective view of the trigger according to the present embodiment.

In the exemplary embodiment illustrated, the trigger mechanism 14 and its pivoting connection about pivot axis 16 define a control linkage for conveying the manipulations of the power tool's operator to the regulator 28. Of course, the linkage may alternatively include additional links and, as noted above, the actuation portion 18 may be supported with respect to the body 11 for other types of relative movement, e.g., linear translation. As such, the control linkage would comprise a sliding connection between the actuation portion 18 and the body 11, rather than the pivoting connection about the pivot axis 16. The locking member 12 is captured in a groove for manual movement between a forward position and a rearward position. The forward position is shown in FIG. 2. The rearward position is shown in FIGS. 5 and 6. The intermediate position is shown in FIGS. 3 and 4.

According to a preferred embodiment of the present invention, the locking member 12 is translatable between the forward or first position and the rearward or second position against the urging of a resilient biasing member 30, e.g., coil spring. Alternatively, the resilient biasing member 30 may include other members known to provide translation biasing. In operation, the power tool's operator engages a contact part 32 to slide the locking member 12 toward the second position, and the resilient biasing member 30 returns the locking member 12 toward the first position. Of course, it is envisioned that different types of relative movement other than translation, e.g., pivoting or rotating, could occur between the locking member 12 and the body 11.

The trigger mechanism 14 and the locking member 12 include cooperating elements for controlling the mode of operation of the actuation portion 18. In a first mode of operation, the trigger is precluded from actuating the motor. In a second mode of operation, the trigger is freely allowed to move between actuated and non-actuated positions. In a third mode of operation, the trigger is retained in the actuated position.

The trigger mechanism includes a first portion or latching element 34 and a second portion or blocking element 36. The first portion 34 upwardly extends toward the locking member 12 and is generally hook shaped. The second portion 36 defines a blocking surface.

The locking member includes a first portion 40 and a second portion 42. The first portion 40 downwardly extends toward the trigger mechanism 14. The second portion 42 downwardly extends toward the trigger mechanism 14 and is generally hook shaped.

As particularly shown in FIG. 2, the power tool 10 is in its first mode of operation in which the actuation portion 18 is precluded from actuating the motor. The trigger mechanism 14 is therefore in its non-actuated position. The locking member 12 is in its forward position. A forwardly extending leg 44 of the first portion 40 of the locking member 12 abuts an upper surface 46 of the first portion 34 of the trigger mechanism 14. Additional blocking contact is provided through engagement of a rearwardly extending leg 48 of the second portion 42 of the locking member 12 and an upper surface of the second portion 36 of the trigger mechanism 14.

An additional benefit of this embodiment is visible in FIG. 2. The locking member 12 and specifically the rearwardly extending leg 48, and the trigger mechanism 14 and specifically the upper surface of the second portion 36, are positioned so that they are as close as practical to the throw switch 26 of the regulator 28. This minimizes the lever arm of the trigger mechanism 14, thereby maximizing the force required to override the lock off position.

Turning to FIG. 3, the power tool is shown in its second mode of operation in which the actuation portion 18 of trigger mechanism 14 is freely allowed to move between its actuated and non-actuated positions. The locking member 12 is shown translated rearward in the direction of arrow A from its forward position of FIG. 2 to its intermediate position in which the first portion 34 of the trigger mechanism 14 is positioned between the first and second portions 40 and 42 of the locking member 12. FIG. 4 similarly shows power tool 10 in the second mode of operation but illustrates the actuation portion 18 articulated to its first actuated position.

With reference to FIG. 5, the locking member 12 is translated rearwardly against the bias of the resilient biasing member 30 to its rear position and the power tool 10 is now in its third mode of operation in which the trigger mechanism 14 will be prevented from return to its non-actuated position.

An additional benefit of the preferred embodiment of the present invention is visible in FIGS. 4, 5, and 6. As the trigger mechanism 14 is actuated through its range of motion (as shown in these figures), the distal end of the actuator portion 24 moves through an arc about the pivot axis 16. The amount of displacement of the throw switch 26 does not vary with additional rotation in either direction of trigger mechanism 14, so long as the trigger mechanism 14 is in the range of motion that engages the distal end of actuator portion 24 with the throw switch 26 of regulator 28 to its ON position. This allows for more economically produced parts, in higher volumes, with the associated increase in variation of the exact sizes and shapes of these parts, without increasing the likelihood that the entire lock on/lock off mechanism will not operate as desired.

In FIG. 6, the trigger mechanism 14 is shown released by the tool user such that the actuation portion 18 rotates slightly in a clockwise direction and the hook-shaped portions 34 and 42 of the trigger mechanism 14 and locking member 12, respectively, engage. Through such engagement, the biasing force of the resilient biasing member 30 is prevented from otherwise returning the locking member 12 to its forward position. Additionally, biasing force of biasing element 22 prevents the trigger mechanism 14 to its original position Disengagement of the hook-shaped portions 34 and 42 is accomplished by manual grasping of the actuator portion 18 by the tool user such that the trigger mechanism 14 rotates counterclockwise about pivot axis 16 to the position shown in FIG. 4. At this point, resilient biasing member 30 forwardly biases the lock member 12 to its intermediate position. The trigger mechanism 14 can now freely return to its non-actuated position upon release of the actuator portion 18 by the user. When this happens, the first portion 34 of the trigger mechanism 14 clears the forwardly extending leg 44 (shown in FIG. 2) of the first portion 40 of the lock member 12 and the spring bias of the resilient biasing member 30 now returns the locking member 12 to its forward position.

In the preferred embodiment of the present invention, the power tool 10 will now be understood to include a locking member 12 and a trigger mechanism 14 which cooperate to lock out the actuation portion 18 and provide continuous operation with reduced operator fatigue. The present invention provides a blocking feature for lock out of the trigger. Additionally, the present invention provides an improved switching feature. Furthermore, the present invention allows for a preferred movement of the locking member 12 between distinct positions for locking out actuation of the actuation portion 18 and maintaining actuation of the actuation portion 18.

When a user picks up the power tool, the locking member 12 in its forward position and inadvertent actuation of the motor is precluded through the engagement of the forwardly extending leg 44 with the first portion 34 of the trigger mechanism 14 and engagement of the rearwardly extending leg 48 with the second portion 36 of the trigger mechanism 14. When the user desires to actuate the motor, the locking member 12 is rearwardly translated to its intermediate position such that the first portion 34 of the trigger mechanism 14 is positioned between the first and second portions 40 and 42 of the locking member 12. At this point, the user can squeeze the actuation portion 18 and articulate the trigger mechanism 14 counterclockwise about the pivot axis 16. If continuous operation of the motor is desired by the user, the locking member 12 can be further rearwardly translated such that the cooperating hook-shaped portions 34 and 42 of the trigger mechanism 14 and locking member 12, respectfully, overlap. When the user releases his or her grasp of the actuation portion 18 the hook-shaped portions 34 and 42 engage and prevent the trigger mechanism 14 from further rotating clockwise to thereby cease actuation of the motor. To discontinue the continuous operation of the motor without grasping the trigger mechanism 14, the user squeezes the trigger mechanism 14 to rotate the trigger mechanism 14 counterclockwise about the pivot access 16 and release engagement of the hook-shaped portions 34 and 42. This action causes the locking member 12 to forwardly translate to its intermediate position such that the trigger mechanism 14 can be freely articulated between actuated and non-actuated positions. As such, manual release of the trigger mechanism 14 allows the trigger mechanism 14 to fully rotate in a clockwise direction about the pivot axis 16 and the locking member 12 to further translate to its full forward position in which actuation of the motor is normally precluded.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A power tool comprising:

a body;

a trigger mechanism mounted to the body for rotation about an axis between an actuated position and a non-actuated position; and a manually operable locking member translationally mounted to the body for movement between a first position and a second position such that the locking member cooperates with the trigger mechanism to provide a first mode of operation when the locking member is in the first position in which articulation of the trigger mechanism from the non-actuated position to the actuated position is precluded, operative in a second operating mode when the locking member is in an intermediate position between the first and second positions in which the trigger mechanism is freely allowed to articulate between the actuated and non-actuated positions, and a third mode of operation when the locking member is in the second position in which the trigger mechanism is prevented from articulating from the non-actuated position to the actuated position.

2. The power tool of claim 1, wherein the trigger mechanism is biased to the non-actuated position.

3. The power tool of claim 1, wherein the locking member is biased to the first position.

4. The power tool of claim 1 wherein the trigger mechanism includes a slot thereon for accepting a switch of a regulator.

5. The power tool of claim 4 wherein the slot further includes a guide portion, the guide portion slideably engaging the switch of the regulator and maintaining the switch of the regulator in a substantially static actuated position upon concurrent displacement of the trigger mechanism.

6. The power tool of claim 1 wherein the locking member further includes a forwardly extending leg and a rearwardly extending leg, the forwardly extending leg arranged to blockingly abut a first portion of the trigger mechanism in the first position.

7. The power tool of claim 6 wherein the trigger mechanism further includes a second portion arranged to blockingly abut the rearwardly extending leg of the locking member in the first position.

8. A power tool comprising:

a body;

a regulator having a switch, the switch actuable between a non-operating position and an operating position;

a linkage adapted to be movably supported by the body between a first mode wherein the linkage is substantially at rest, a second mode wherein the linkage is adapted to be manipulated by the operator and a third mode wherein the linkage is adapted to maintain the switch of the regulator in an operating position, the linkage including:

a first portion adapted to be engaged by the operator for moving the linkage relative to the body, a second portion adapted for maintaining the linkage in the first mode, a third portion adapted for maintaining the linkage in the third mode, and a fourth portion for slideably engaging the switch of the regulator, the fourth portion translatable along a generally perpendicular path with respect to the switch; and a locking member adapted to be moved by the operator relative to the body, the locking member movable between a first position substantially maintaining the linkage in the first mode and a second position substantially maintaining the linkage in the third mode, the locking member having:

a first part adapted to be engaged by the operator for moving the locking member relative to the body, and a second part adapted to blockingly engage the second portion of the linkage in the first mode and to cooperatively engage the third portion of the linkage in the third mode.

9. The power tool of claim 8 wherein the locking member further includes a third part adapted to blockingly engage the third portion of the linkage in the first mode.

10. The power tool of claim 8, wherein the fourth portion of the linkage further includes a slot thereon for accepting the switch of the regulator.

11. The power tool of claim 9, wherein the slot includes a ramped portion for communicating with the switch of the regulator between the non-operating position and the operating position.

12. The power tool of claim 10, wherein the slot further includes a guide portion, the guide portion slideably engaging the switch of the regulator and maintaining the switch in an operating position upon concurrent displacement of the first portion of the linkage beyond from the ramped portion.

13. The power tool of claim 11, wherein the linkage is pivotally actuable between the non-operating position and operating position, the guide portion of the slot having an annular contour allowing the switch to remain in a substantially static operating position upon concurrent slideable engagement of the guide portion and the switch.

14. The power tool of claim 8, wherein the operating linkage is biased to the non-operating position.

15. The power tool of claim 8, wherein the locking member is biased to the first position.

16. A power tool comprising:

a body;

an regulator having a switch, the switch actuable between a non-operating position and an operating position;

a linkage adapted to be movably supported by the body between a first mode wherein the linkage is substantially at rest, a second mode wherein the linkage is adapted to be manipulated by the operator and a third mode wherein the linkage is adapted to maintain the switch of the regulator in an operating position, the linkage including:

a first portion adapted to be engaged by the operator for moving the linkage relative to the body, a second portion adapted for maintaining the linkage in the first mode, a third portion adapted for maintaining the linkage in the third mode, and a fourth portion for slideably engaging the switch of the regulator, the fourth portion translatable along a generally perpendicular path with respect to the switch, the fourth portion configured to allow movement of the linkage while maintaining the switch of the regulator in a substantially static operating position; and a locking member adapted to be moved by the operator relative to the body, the locking member movable between a first position substantially maintaining the linkage in the first mode and a second position substantially maintaining the linkage in the third mode, the locking member having:

a first part adapted to be engaged by the operator for moving the locking member relative to the body, a second part adapted to blockingly engage the second portion of the linkage in the first mode and to cooperatively engage the third portion of the linkage in the third mode, and a third part adapted to blockingly engage the third portion of the linkage in the first mode.

17. The power tool of claim 16 wherein the linkage is pivotally actuable.

18. The power tool of claim 16 wherein the linkage is biased to the non-operating position.

19. The power tool of claim 16 wherein the locking member is biased to the first position.

20. The power tool of claim 16 wherein the switch of the regulator engages an arcuate contact surface of the fourth portion in the operating position.

* * * * *